US011731251B2

(12) United States Patent
Fairchild

(10) Patent No.: US 11,731,251 B2
(45) Date of Patent: Aug. 22, 2023

(54) IMPACT DRIVING DEVICE WITH OFFSET AXIS TORQUE TRANSFER ASSEMBLY

(71) Applicant: Apex Brands, Inc., Apex, NC (US)

(72) Inventor: Adam Fairchild, Lexington, SC (US)

(73) Assignee: APEX BRANDS, INC., Apex, NC (US)

( * ) Notice: Subject to any disclaimer, the term of this patent is extended or adjusted under 35 U.S.C. 154(b) by 0 days.

(21) Appl. No.: 18/118,301

(22) Filed: Mar. 7, 2023

(65) Prior Publication Data

US 2023/0202005 A1 Jun. 29, 2023

Related U.S. Application Data

(63) Continuation of application No. PCT/US2021/049371, filed on Sep. 8, 2021.

(60) Provisional application No. 63/075,603, filed on Sep. 8, 2020.

(51) Int. Cl.
*B25B 23/00* (2006.01)
*B25B 21/02* (2006.01)

(52) U.S. Cl.
CPC ..... *B25B 23/0035* (2013.01); *B25B 21/02* (2013.01)

(58) Field of Classification Search
CPC ..... B25B 15/00; B25B 15/02; B25B 21/02; B25B 21/023; B25B 23/0007; B25B 23/0035
See application file for complete search history.

(56) References Cited

U.S. PATENT DOCUMENTS 8,109,183 B2 * 2/2012 Santamarina ..... B25B 23/1405 81/477
9,469,017 B2 * 10/2016 Seith ..... B25B 21/02
2011/0036212 A1 * 2/2011 Santamarina ..... B25B 23/14 81/436
2019/0232470 A1 * 8/2019 Xu ..... B25B 23/0035
2021/0331302 A1 * 10/2021 Fairchild ..... B25B 23/1405

* cited by examiner

*Primary Examiner* — David B. Thomas
(74) *Attorney, Agent, or Firm* — Burr & Forman LLP

(57) ABSTRACT

An impact bit holder may include a drive body having a drive end configured to interface with a powered driver, a driven body having a driven end configured to interface with a bit, and an elastic torque transfer assembly configured to operably couple the drive body to the driven body. The drive body and the driven body share a common axis under a no load condition. The elastic torque transfer assembly may include a coupling protrusion and a coupling channel disposed at a coupling axis offset from the common axis such that the coupling protrusion extends into the coupling channel to operably couple the drive body to the driven body.

20 Claims, 5 Drawing Sheets

FIG. 2A
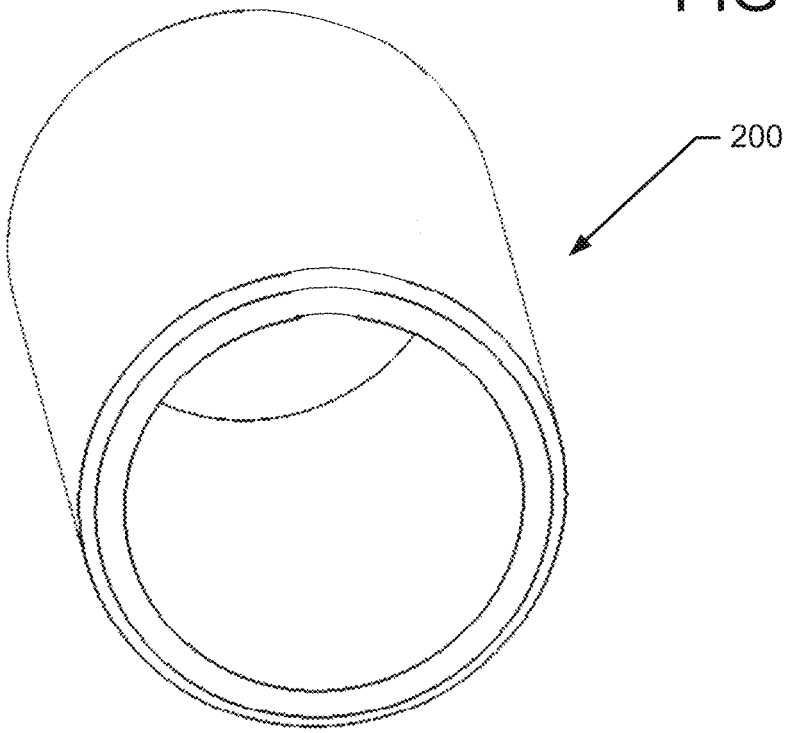
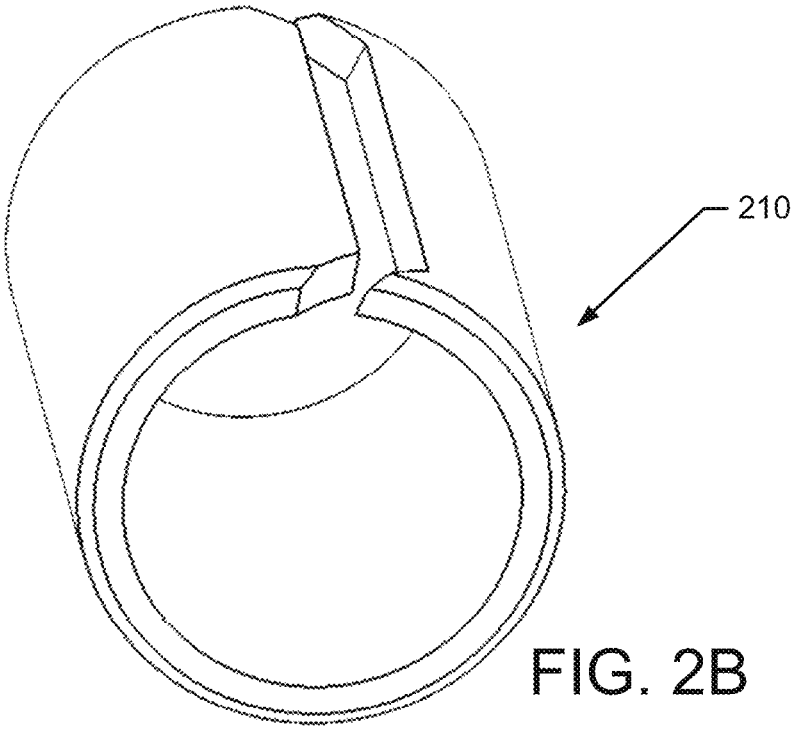
FIG. 2B

IMPACT DRIVING DEVICE WITH OFFSET AXIS TORQUE TRANSFER ASSEMBLY

TECHNICAL FIELD

Example embodiments generally relate to driving devices such as socket tools, bit holders and other fastener driving components. In particular, example embodiments relate to impact drivers, and provide a form of overload protection for impact drivers.

BACKGROUND

Driving devices, such as socket tools and bit holders, are familiar tools for fastening nuts and driving other drivable components or fasteners. Bit holders, for example, often have a drive end that includes a conventional interface for receiving drive energy from a powered driving device. The drive end may have a standard sized hex head or another conventional power bit drive end geometry. The bit holder may also include a driven end, which is driven by the rotational force applied by the powered driving device at the drive end, and which in turn applies drive energy to a bit. The bit may be received in a hex shaped socket, or any other bit holding geometry that defines a receptacle for the bit.

Bits of various sizes and shapes may have standard (e.g., hex) heads that enable any of the various different bits to interchangeably be inserted into the bit holder. Thus, by attaching the bit holder to the powered driving device (e.g., via a chuck of the powered driving device), any number of different bits can quickly and easily be substituted to meet each situation that is encountered. Because high torque is often applied through these tools, and high strength and durability is desirable, the bit holders are traditionally made of a metallic material such as iron or steel.

Impact drivers are typically employed to apply high and sudden torque to fasteners. The high and sudden torque application made possible by these devices may be particularly useful for loosening of frozen or over-torqued fasteners. However, the application of high and sudden torque may also be useful for applying a high torque to a fastening device that is being used in a context that requires a high input torque. In either case, if a bit holder is used with an impact driver, and the bit holder is rigidly made of metallic materials, the suddenness of the application of force by the powered driving device is equally suddenly applied through the bit holder and to the bit, which could damage the bit, the fastener, or even the bit holder. Thus, it may be desirable to improve bit holder design to lengthen the useful life of driver bits and bit holders.

BRIEF SUMMARY OF SOME EXAMPLES

Some example embodiments may enable the provision of a bit driver that includes a driven end and drive end that are operably coupled to each other via a torque transfer mechanism that, although still applying full impact energy, ensures that loads through the bit holder (and the bit) are not absorbed or dissipated entirely. Thus, high hardness driver bit life can be considerably lengthened.

In an example embodiment, an elastic torque transfer assembly for a bit holder is provided. The elastic torque transfer assembly may include a coupling protrusion disposed at one of a drive body or a driven body of the bit holder, and a coupling channel disposed at the other of the driven body or the drive body. The coupling channel and the coupling protrusion may each be disposed at a coupling axis offset from a common axis of the bit holder at a no load condition. The coupling protrusion may extend into the coupling channel to operably couple the drive body to the driven body at the coupling axis.

In another example embodiment, an impact bit holder may be provided. The impact bit holder may include a drive body having a drive end configured to interface with a powered driver, a driven body having a driven end configured to interface with a bit, and an elastic torque transfer assembly configured to operably couple the drive body to the driven body. The drive body and the driven body share a common axis under a no load condition. The elastic torque transfer assembly may include a coupling protrusion and a coupling channel disposed at a coupling axis offset from the common axis such that the coupling protrusion extends into the coupling channel to operably couple the drive body to the driven body.

In yet another example embodiment, an elastic torque transfer assembly for a bit holder is provided. The elastic torque transfer assembly may include a first coupling protrusion disposed at one of a drive body or a coupling body of the bit holder, a first coupling channel disposed at the other of the coupling body or the drive body, a second coupling protrusion disposed at one of the driven body or the coupling body, and a second coupling channel is disposed at the other of the coupling body or the driven body. The first coupling protrusion and the first coupling channel may each be offset from a common axis of the bit holder under no load at a first coupling axis. The second coupling protrusion and the second coupling channel may each be offset from the common axis of the bit holder and the first coupling axis at a second coupling axis.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

FIG. 2A is a perspective view of a continuous retaining ring in isolation according to an example embodiment;

FIG. 2B is a perspective view of a split dowel retaining ring in isolation according to an example embodiment;

DETAILED DESCRIPTION

Figure 1A:
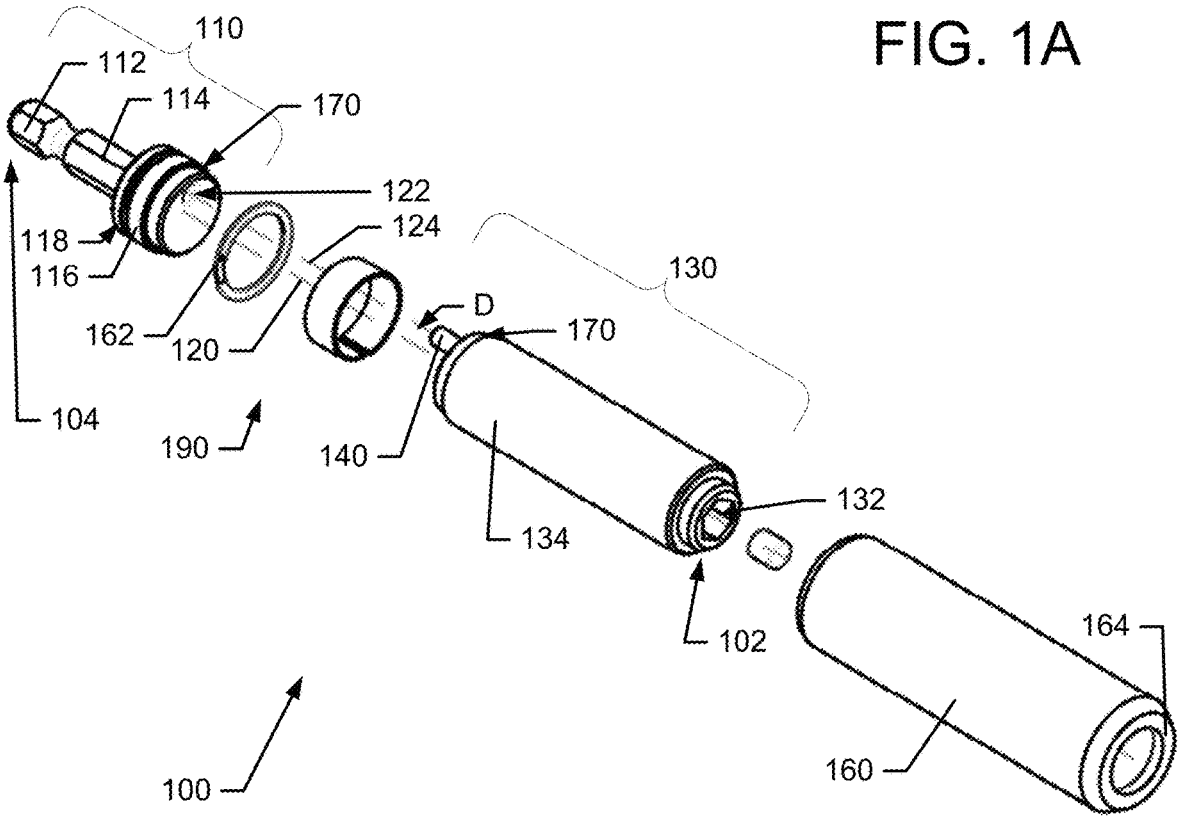
FIG. 1A illustrates an exploded perspective view of a bit holder having an offset axis torque transfer assembly according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, some example embodiments may relate to the provision of driving tool such as a bit holder that can be used with impact drivers. In an example embodiment, the driving tool (which will be described as a bit holder to illustrate one example) may be constructed in such a way as to prevent the bit holder from absorbing and dissipating all of the torque load applied thereto within the metal shaft or core of such device. Instead, a structure is employed that strategically distributes forces within the device without reducing the overall impact energy that can be delivered through the device. For example, the bit holder described herein may include a drive end and a driven end that are made separately, and that do not couple torque therebetween directly. Instead, the drive end and the driven end are operably coupled to each other via an elastic torque transfer assembly. Some structures that can employ example embodiments will now be described below by way of example and not limitation.

Figure 1B:
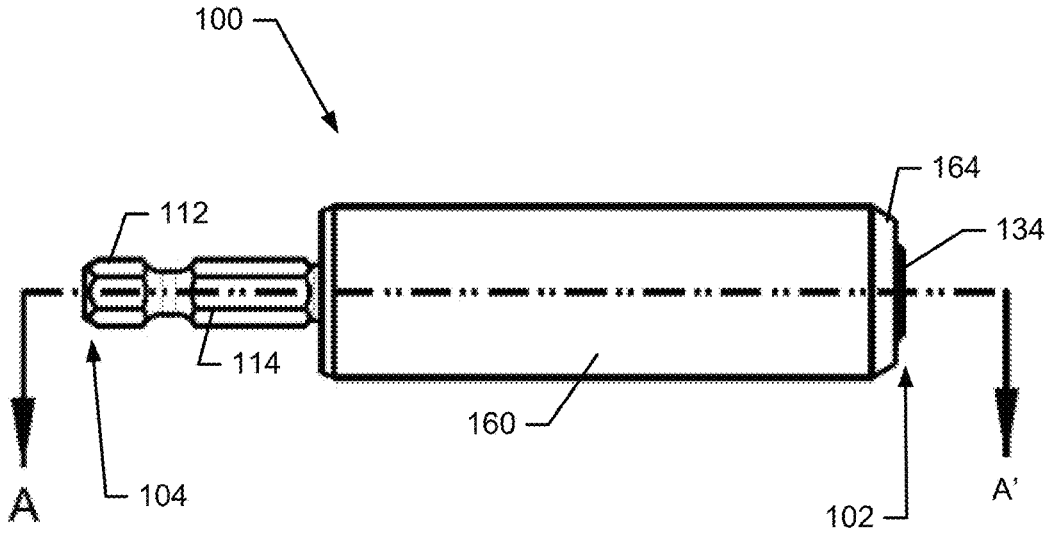
FIG. 1B is a top view of the bit holder of FIG. 1A fully assembled in accordance with an example embodiment.
Figure 1C:
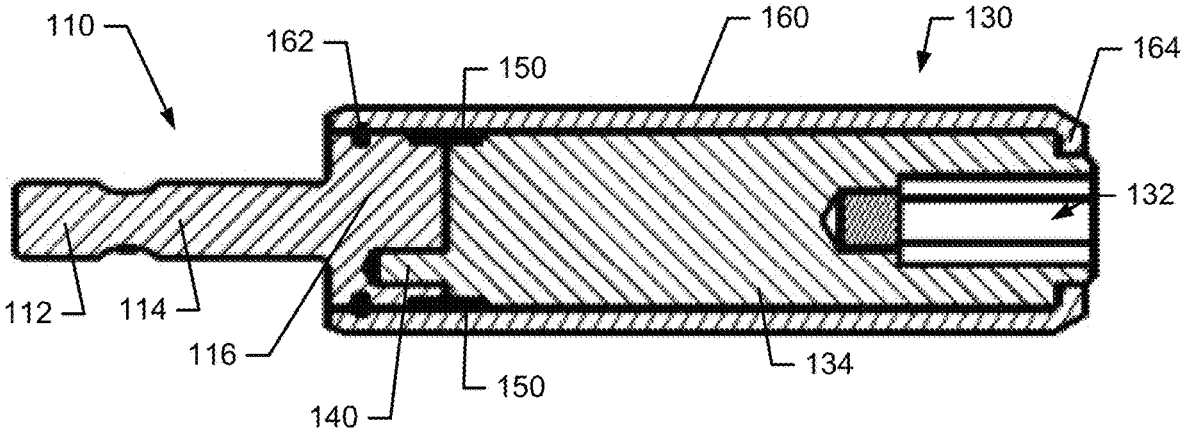
FIG. 1C is a cross section view of the bit holder taken along line A-A' of FIG. 1B in accordance with an example embodiment.

FIG. 1A illustrates an exploded view of a bit holder 100 according to an example embodiment. FIG. 1B is a top view of the bit holder 100 of FIG. 1A, and FIG. 1C illustrates a cross section view taken along line A-A' in FIG. 1B. The bit holder 100 may be defined by a driven end 102 and a drive end 104, which are each separate components that are operably coupled together via an elastic torque transfer assembly 190 of an example embodiment.

As noted above, the drive end 104 is configured to interface with a powered driving device and the driven end 102 is configured to interface with a bit. The drive end 104 may include a drive body 110. The drive body 110 may include or be defined by a hex head 112 and shaft 114 that are coaxial with each other and a base portion 116. The base portion 116 may be a substantially cylindrical body that includes a radial channel 118 disposed around an outer periphery thereof. The radial channel 118 may be an annular groove disposed around an outside of the base portion 116 that is usable for axial fixing of the drive body 110 relative to other portions of the bit holder 100 as described in greater detail below.

As shown in FIG. 1A, an axis of the drive body 110 may align with an axis 120 of the bit holder 100 itself. Meanwhile, a coupling channel 122 may be formed in the base portion 116 at a coupling axis 124 extending parallel to, but offset from, the axis 120. The coupling channel 122 may extend inwardly from a distal end of the drive body 110 (relative to the hex head 112) toward the shaft 114. The coupling channel 122 may be bored (or formed) as a substantially cylindrical channel that is purposely provided spaced apart from (but otherwise parallel to) the axis 120 of the bit holder 100 by a given distance D, which defines the distance between the coupling axis 124 and the axis 120.

The driven end 102 may include a driven body 130. The driven end 102 may be configured to interface with the bit in order to drive the bit responsive to the application of torque by the powered driving device to the drive end 104. The driven body 130 may include a hex socket 132 and socket body 134 that are coaxial with each other (and the axis 120 when assembled). The socket body 134 may include a coupling protrusion 140 that extends substantially parallel to the axis 120, but offset therefrom by the given distance D. Moreover, the coupling protrusion 140 may be aligned with the coupling axis 124, and therefore aligned with and insertable into the coupling channel 122, when the drive body 110 and driven body 130 are mated together.

In an example embodiment, the socket body 134 and the base portion 116 may each have substantially cylindrical portions that each have a corresponding axial center. The diameter of the cylindrical portions of the socket body 134 and the base portion 116 may each be about equal. Accordingly, when operably coupled to each other with corresponding axial centers aligned, outer peripheral edges or surfaces of the socket body 134 and the base portion 116 may substantially align to form a cylindrical shape.

Distal end surfaces of the socket body 134 and the base portion 116 that face each other (i.e., bases of the corresponding substantially cylindrical portions) may each be substantially flat (other than the coupling channel 122 and the coupling protrusion 140) such that, when the coupling protrusion 140 is inserted into the coupling channel 122, the distal end surfaces may contact each other at a coupling interface. Since both of the distal end surfaces are flat, the distal end surfaces of the socket body 134 and the base portion 116 may slide relative to one another at the coupling interface with little to no friction therebetween responsive to pivoting of the drive body 110 relative to the driven body 130. Moreover, it will be appreciated that any such pivoting of the drive body 110 relative to the driven body 130 will occur about the coupling axis 124 and not about the axis 120 due to the offset nature of the coupling channel 122 and the coupling protrusion 140.

If the coupling channel 122 and the coupling protrusion 140 were placed on the axis 120, any pivoting of the drive body 110 relative to the driven body 130 would also be coaxial so that an axial center of the drive body 110 would stay in alignment with an axial center of the driven body 130. However, the movement of the coupling channel 122 and the coupling protrusion 140 to the coupling axis 124 (which is not aligned with the axis 120) necessarily results in the axial center of the drive body 110 moving out of alignment with the axial center of the driven body 130 when the drive body 110 pivots relative to the driven body 130. The outer peripheral surfaces of the socket body 134 and the base portion 116 therefore also move out of alignment with each other.

In an example embodiment, a retaining ring 150 may be provided to extend around the coupling interface (e.g., where the outer peripheral surfaces of the socket body 134 and the base portion 116 meet). The retaining ring 150 may limit the movement that is allowed between the drive body 110 and the driven body 130. In some cases, the retaining ring 150 may be a continuous ring 200 as shown in FIG. 2A or as a split dowel 210 as shown in FIG. 2B. In either case, the retaining ring 150 may resist misalignment of the outer peripheral surfaces of the socket body 134 and the base portion 116. In this regard, the retaining ring 150 may define displacement curve descriptive of the amount of displacement change (e.g., from zero to a maximum value, and then back to zero) that occurs when the drive body 110 and driven body 130 move relative to one another. The displacement curve therefore shows the effects of the resistance of the retaining ring 150 in allowing some displacement, which is resisted until a maximum is reached, and then decreases until alignment is returned after torque is no longer applied.

Assembly of these components may be relatively straightforward, but may provide a flexible coupling that protects the bit holder 100. In this regard, for example, the drive body 110 and driven body 130 may each be cast separately and installed together upon alignment and insertion of the coupling protrusion 140 into the coupling channel 122. In some cases, the retaining ring 150 may be provided in place in advance of such insertion, and then a sleeve or shell 160 may be formed to axially retain the drive body 110 relative to the driven body 130. In this regard, for example, an axial retainer 162 may be disposed in the radial channel 118 of the base portion 116. Meanwhile, the shell 160 may include an axial limiter 164 that extends around a portion of the socket body 134. The axial limiter 164 and the axial retainer 162 may combine to prevent axial separation of the drive body 110 from the driven body 130.

The shell 160 may be made of a composite material, resin, or the like. The shell 160 may extend also over the coupling interface, and therefore could also inhibit rotation of the drive body 110 relative to the driven body 130 as described above. The shell 160 may therefore, in some cases, be used instead of the retaining ring 150. However, in other cases, the shell 160 may reinforce the retaining ring 150 relative to resisting axial misalignment of the drive body 110 and the driven body 130. When used, the shell 160 may be provided to insulate the bit holder 100 electrically and/or prevent galling of either the bit holder 100 or other components the bit holder 100 may contact during usage.

Accordingly, in this example, the coupling projection 140, the coupling channel 122 and either one or both of the retaining ring 150 and the shell 160 may form the elastic torque transfer assembly 190 of this example embodiment. However, it should be appreciated that the coupling channel 122 and the coupling projection 140 could easily be swapped in their respective locations. For example, the coupling projection 140 could instead be located on the drive body 110, and the coupling channel 122 could instead be formed in the driven body 130 without changing the mode of operation at all. As such, the elastic torque transfer assembly 190 of example embodiments does not necessarily restrict the coupling channel 122 and coupling projection 140 to any particular location.

It should also be appreciated that in some cases, the retaining ring 150 may be provided over the outer peripheral edges or surfaces of the socket body 134 and the base portion 116. However, in other cases, a trench 170 may be formed in one or both of the outer peripheral edges or surfaces of the socket body 134 and the base portion 116 proximate to the coupling interface, and the retaining ring 150 may be provided in the trench 170. The trench 170 may have a smaller diameter than other portions of the socket body 134 and the base portion 116.

Figure 3A:
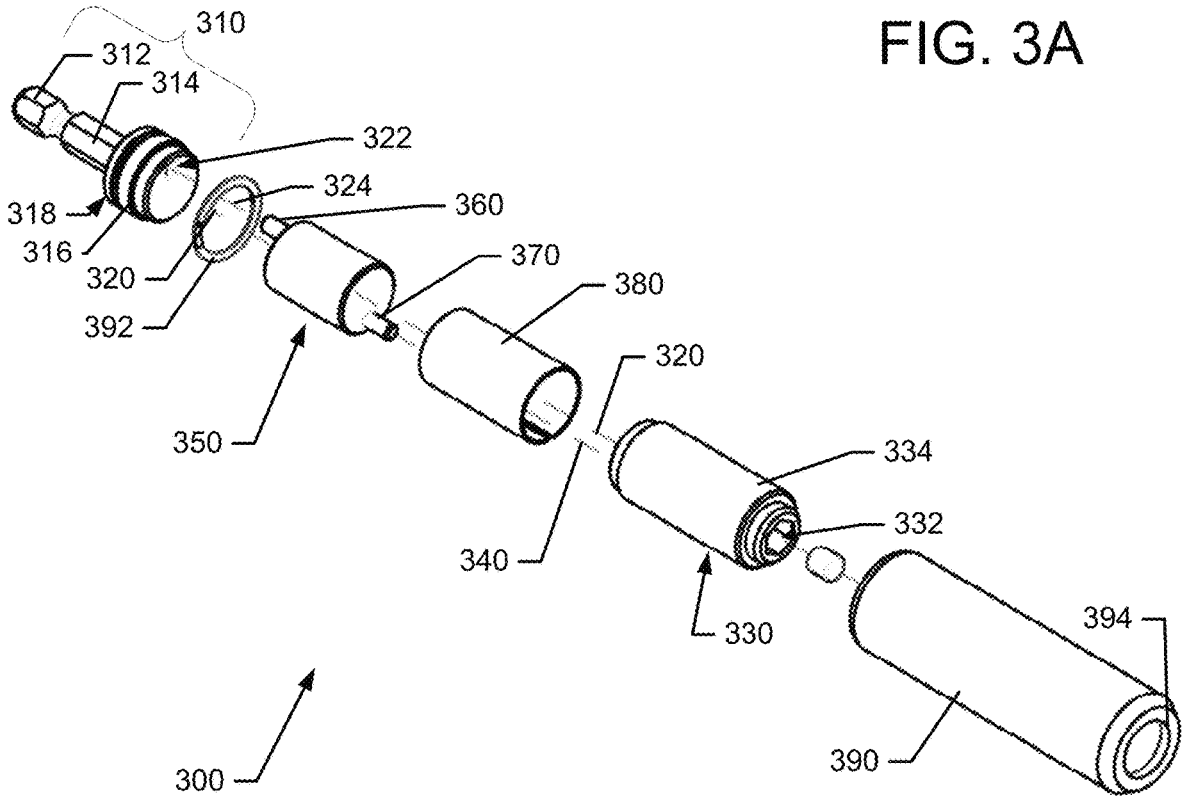
FIG. 3A illustrates an exploded perspective view of a bit holder having a double-linkage offset axis torque transfer assembly according to an example embodiment.
Figure 3B:
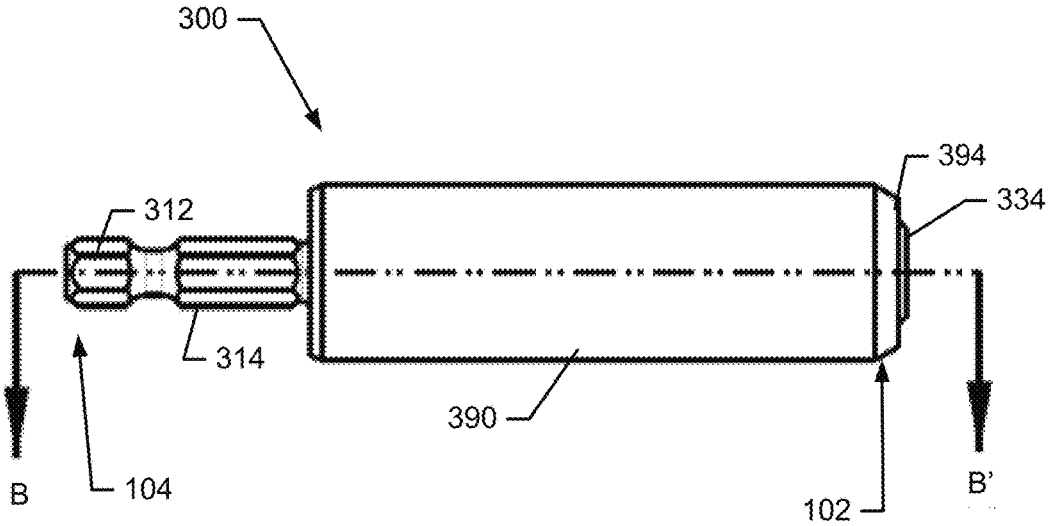
FIG. 3B is a top view of the bit holder of FIG. 3A fully assembled in accordance with an example embodiment.
Figure 3C:
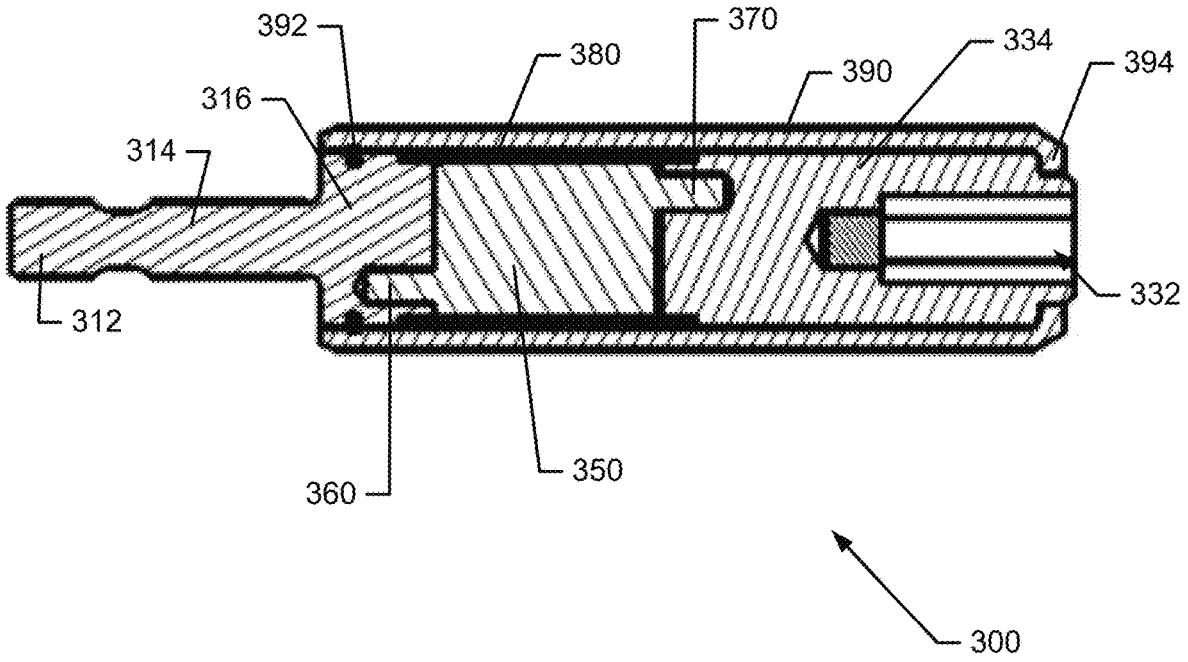
FIG. 3C is a cross section view of the bit holder taken along line B-B' of FIG. 3B in accordance with an example embodiment.

The example of FIGS. 1A, 1B and 1C can therefore be thought of as a single-linkage offset axis torque transfer assembly since there is a single coupling interface that forms the elastic torque transfer assembly 190. However, it is also possible that more than one coupling interface could be defined (and correspondingly also more than one coupling projection and coupling channel) in an alternative design. FIGS. 3A, 3B and 3C show similar views to those of FIGS. 1A-1C, respectively, for an alternative design with a double-linkage offset axis torque transfer assembly.

The bit holder 300 of FIGS. 3A, 3B and 3C may also include a drive body 310 and driven body 330. The drive body 310 may include or be defined by a hex head 312 and shaft 314 that are coaxial with each other and a base portion 316, all of which may be similar to the corresponding drive body 110, hex head 112, shaft 114 and base portion 116 described above. As such, the base portion 316 may be a substantially cylindrical body that includes a radial channel 318 disposed around an outer periphery thereof. The radial channel 318 may be an annular groove disposed around an outside of the base portion 316 that is usable for axial fixing of the drive body 310 relative to other portions of the bit holder 300 as described in greater detail below.

As shown in FIG. 3A, a central axis of the drive body 310 may align with an axis 320 of the bit holder 300 itself. Meanwhile, a first coupling channel 322 may be formed in the base portion 316 at a first coupling axis 324 extending parallel to, but offset from, the axis 320. The first coupling channel 322 may extend inwardly from a distal end of the drive body 310 (relative to the hex head 312) toward the shaft 314. The first coupling channel 322 may be bored (or formed) as a substantially cylindrical channel that is purposely provided spaced apart from (but otherwise parallel to) the axis 320 of the bit holder 300 by a given distance D, which defines the distance between the first coupling axis 324 and the axis 320.

The driven body 330 may include a hex socket 332 and socket body 334 that are coaxial with each other (and the axis 320 when assembled). However, unlike the socket body 134 described above, the socket body 334 of this example includes a second coupling channel 338 instead of a coupling protrusion. The second coupling channel 338 is formed in the socket body 334 offset from the axis 320 by the given distance D at a second coupling axis 340. In this example, the first and second coupling axes 322 and 340 may be directly opposite one another relative to the axis 320. However, other positioning options for the first and second coupling axes 322 and 340 (including aligned) are also possible.

Meanwhile, in between the drive body 310 and driven body 330, a coupling body 350 may be provided. The coupling body 350 may be a substantially cylindrical body having a central axis that normally aligns with the axis 320 when under no load and fully assembled. The coupling body 350 may therefore have a flat base portion at each opposite end thereof, which face the drive body 310 and driven body 330, respectively. The coupling body 350 may include a first coupling protrusion 360 that extends substantially parallel to the axis 320, but is offset therefrom by the given distance D. Moreover, the first coupling protrusion 360 may be aligned with the first coupling axis 324, and therefore aligned with and insertable into the first coupling channel 322, when the drive body 310 and driven body 330 are mated together. However, the coupling body 350 may also include a second coupling protrusion 370 that extends substantially parallel to the axis 320, but is offset therefrom by the given distance D. Moreover, the second coupling protrusion 370 may be aligned with the second coupling axis 340, and therefore aligned with and insertable into the second coupling channel 338, when the drive body 310 and driven body 330 are mated together. Like the first and second coupling axes 322 and 340, the first and second coupling protrusions 360 and 370 may be directly opposite one another relative to the axis 320 (in a radial direction), and may extend away from opposing base portions of the coupling body 350 in opposite axial directions. However, other positioning options (including aligned) for the first and second coupling protrusions 360 and 370 are also possible.

In an example embodiment, the socket body 334 and the base portion 316 may each have substantially cylindrical portions that each have a corresponding axial center. The diameter of the cylindrical portions of the socket body 134 and the base portion 116 may each be about equal, and may also be about equal to a diameter of the coupling body 350. Accordingly, when operably coupled to each other with corresponding axial centers aligned, outer peripheral edges or surfaces of the socket body 334, the coupling body 350 and the base portion 316 may substantially align to form a cylindrical shape.

Distal end surfaces of the socket body 334 and the base portion 316 that face each other (i.e., bases of the corresponding substantially cylindrical portions), and the bases of the coupling body 350, may each be substantially flat (other than the first and second coupling channels 322 and 340, and the first and second coupling protrusions 360 and 370). Accordingly, when the first coupling protrusion 360 is inserted into the first coupling channel 322, the distal end surface of the base portion 316 may contact the corresponding base of the coupling body 350 a first coupling interface. Similarly, when the second coupling protrusion 370 is inserted into the second coupling channel 342, the distal end surface of the socket body 334 may contact the corresponding base of the coupling body 350 at a second coupling interface. Since all such end surfaces are flat, the socket body 334 and coupling body 350, and the base portion 316 and the coupling body 350, may slide relative to one another at the first and second coupling interfaces with little to no friction therebetween responsive to pivoting of the drive body 310 relative to the driven body 330. Moreover, it will be appreciated that any such pivoting of the drive body 310 relative to the driven body 330 will occur about the first and second coupling axes 324 and 340, and not about the axis 320 due to the offset nature of the first and second coupling axes 324 and 340 and the first and second coupling protrusions 360 and 370.

In an example embodiment, a retaining ring 380 may be provided to extend around the first and second coupling interfaces (e.g., where the outer peripheral surfaces of the socket body 334 and coupling body 350 meet, and where the outer peripheral surfaces of the coupling body 350 and the base portion 116 meet). The retaining ring 380 may limit the movement that is allowed between the drive body 310 and the driven body 330. As noted above, the retaining ring 380 may be either continuous or a split dowel. Moreover, the retaining ring 380 could be a single ring (as shown in FIGS. 3A and 3C, or multiple rings). In some cases, a first ring may correspond to the first coupling interface and a second ring may correspond to the second coupling interface. In any case, the retaining ring 380 (or rings) may resist misalignment of the outer peripheral surfaces of the socket body 334, the coupling body 350 and the base portion 316. In this regard, the retaining ring 380 may define displacement curve descriptive of the amount of displacement change (e.g., from zero to a maximum value, and then back to zero) that occurs when the drive body 310 and driven body 330 move relative to one another, as discussed above.

In some cases, a sleeve or shell 390 may be formed to axially retain the drive body 310 relative to the driven body 330. In this regard, for example, an axial retainer 392 may be disposed in the radial channel 318 of the base portion 316. Meanwhile, the shell 390 may include an axial limiter 394 that extends around a portion of the socket body 334. The axial limiter 394 and the axial retainer 392 may combine to prevent axial separation of the drive body 310 from the driven body 330.

The shell 390 may be made of a composite material, resin, or the like. The shell 390 may extend also over the first and second coupling interfaces, and therefore could also inhibit rotation of the drive body 310 relative to the driven body 330 and the coupling body 350 as described above. The shell 390 may therefore, in some cases, be used instead of the retaining ring 380. However, in other cases, the shell 390 may reinforce the retaining ring 380 relative to resisting axial misalignment of the drive body 310 and the driven body 330.

Accordingly, in this example, the first and second coupling projections 360 and 370, the first and second coupling channels 322 and 340, the coupling body 350, and either one or both of the retaining ring 380 and the shell 390 may form the elastic torque transfer assembly of this example embodiment. However, it should be appreciated that the projections and channels could be swapped in this example also without changing the mode of operation at all. As such, the elastic torque transfer assembly of example embodiments does not necessarily restrict the first and second coupling channels 322 and 340, or the first and second coupling projections 360 and 370 to any particular location.

When the elastic torque transfer assembly of example embodiments is formed, a torque (e.g., an instantaneously applied high amount of torque from an impact driver) applied at the drive body 110/310 will correspondingly apply torque to the driven body 130/330 via the elastic torque transfer assembly. However, the action of the elastic torque transfer assembly elastically couples the torque in a way where full torque is achieved, but not instantaneously, so as to protect the bit holder 100/300.

The torque transfer assembly of some example embodiments may include dual functions of holding the drive body 110/310 and the driven body 130/330 in proximity to each other axially and of transferring (or communicating) torque from the drive body 110/310 to the driven body 130/330 in an efficient, yet safe, manner. These two functions may be performed by the elastic nature of the elastic torque transfer assembly.

Accordingly, a driving device (e.g., an impact bit holder) of an example embodiment, or a torque transfer assembly included in such a driving device, may be provided. The impact bit holder may include a drive body having a drive end configured to interface with a powered driver, a driven body having a driven end configured to interface with a bit, and an elastic torque transfer assembly configured to operably couple the drive body to the driven body. The drive body and the driven body share a common axis under a no load condition. The elastic torque transfer assembly may include a coupling protrusion and a coupling channel disposed at a coupling axis offset from the common axis such that the coupling protrusion extends into the coupling channel to operably couple the drive body to the driven body.

In some embodiments, the bit holder may include additional, optional features, and/or the features described above may be modified or augmented. Some examples of modifications, optional features and augmentations are described below. It should be appreciated that the modifications, optional features and augmentations may each be added alone, or they may be added cumulatively in any desirable combination. In an example embodiment, the coupling protrusion may be disposed at one of the drive body or the driven body, and the coupling channel may be disposed at the other of the driven body or the drive body. In some cases, the drive body and the driven body meet at a coupling interface, and the elastic torque transfer assembly further includes a retaining ring disposed to extend around the coupling interface to resist misalignment of the drive body and the driven body responsive to application of torque to the impact bit holder. In an example embodiment, the retaining ring may include a continuous ring or a split dowel. In some cases, the drive body may include a base portion into which the coupling channel extends, the driven body may include a socket body from which the coupling protrusion extends, the coupling protrusion and the coupling channel may be displaced from the common axis by the same distance, and respective end faces of the socket body and the base portion may slide against each other responsive to the application of torque to the impact bit holder. In an example embodiment, the retaining ring may be disposed in a trench on each of the socket body and the base portion. The trench may have a smaller diameter than other portions of the socket body and the base portion. In some cases, a sleeve may be disposed to extend around the retaining ring and at least a portion of each of the socket body and the base portion. In an example embodiment, the sleeve may include a resin or composite material. In some cases, the sleeve may be configured to axially retain the socket body relative to the base portion. In an example embodiment, the elastic torque transfer assembly may include a coupling body disposed between the drive body and the driven body. The coupling protrusion may be disposed at one of the drive body or the coupling body, and the coupling channel may be disposed at the other of the coupling body or the drive body. A second coupling protrusion may be disposed at one of the driven body or the coupling body, and a second coupling channel may be disposed at the other of the coupling body or the driven body. In some cases, the second coupling protrusion and the second coupling channel may each be offset from the common axis and the coupling axis at a second coupling axis. In an example embodiment, the drive body meets the coupling body at a first coupling interface, and the driven body meets the coupling body at a second coupling interface. The elastic torque transfer assembly may further include a retaining ring disposed to extend around the first and second coupling interfaces to resist misalignment of the drive body and the driven body relative to the coupling body responsive to application of torque to the impact bit holder. In some cases, a sleeve is disposed to extend around the retaining ring and at least a portion of each of the socket body and the base portion to axially retain the drive body relative to the driven body.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An impact bit holder comprising:

a drive body having a drive end configured to interface with a powered driver;

a driven body having a driven end configured to interface with a bit; and an elastic torque transfer assembly configured to operably couple the drive body to the driven body, wherein the drive body and the driven body share a common axis under a no load condition, and wherein the elastic torque transfer assembly comprises a coupling protrusion and a coupling channel disposed at a coupling axis offset from the common axis such that the coupling protrusion extends into the coupling channel to operably couple the drive body to the driven body.

2. The impact bit holder of claim 1, wherein the coupling protrusion is disposed at one of the drive body or the driven body, and the coupling channel is disposed at the other of the driven body or the drive body.

3. The impact bit holder of claim 2, wherein the drive body and the driven body meet at a coupling interface, and wherein the elastic torque transfer assembly further comprises a retaining ring disposed to extend around the coupling interface to resist misalignment of the drive body and the driven body responsive to application of torque to the impact bit holder.

4. The impact bit holder of claim 3, wherein the retaining ring comprises a continuous ring or a split dowel.

5. The impact bit holder of claim 3, wherein the drive body comprises a base portion into which the coupling channel extends, wherein the driven body comprises a socket body from which the coupling protrusion extends, wherein the coupling protrusion and the coupling channel are displaced from the common axis by the same distance, and wherein respective end faces of the socket body and the base portion slide against each other responsive to the application of torque to the impact bit holder.

6. The impact bit holder of claim 5, wherein the retaining ring is disposed in a trench on each of the socket body and the base portion, the trench having a smaller diameter than other portions of the socket body and the base portion.

7. The impact bit holder of claim 5, wherein a sleeve is disposed to extend around the retaining ring and at least a portion of each of the socket body and the base portion.

8. The impact bit holder of claim 7, wherein the sleeve comprises a resin or composite material.

9. The impact bit holder of claim 7, wherein the sleeve is configured to axially retain the socket body relative to the base portion.

10. The impact bit holder of claim 1, wherein the elastic torque transfer assembly comprises a coupling body disposed between the drive body and the driven body, wherein the coupling protrusion is disposed at one of the drive body or the coupling body, and the coupling channel is disposed at the other of the coupling body or the drive body, and wherein a second coupling protrusion is disposed at one of the driven body or the coupling body, and a second coupling channel is disposed at the other of the coupling body or the driven body.

11. The impact bit holder of claim 10, wherein the second coupling protrusion and the second coupling channel are each offset from the common axis and the coupling axis at a second coupling axis.

12. The impact bit holder of claim 11, wherein the drive body meets the coupling body at a first coupling interface, and the driven body meets the coupling body at a second coupling interface, and wherein the elastic torque transfer assembly further comprises a retaining ring disposed to extend around the first and second coupling interfaces to resist misalignment of the drive body and the driven body relative to the coupling body responsive to application of torque to the impact bit holder.

13. The impact bit holder of claim 12, wherein a sleeve is disposed to extend around the retaining ring and at least a portion of each of the socket body and the base portion to axially retain the drive body relative to the driven body.

14. An elastic torque transfer assembly for a bit holder, the elastic torque transfer assembly comprising:

a coupling protrusion disposed at one of a drive body or a driven body of the bit holder; and a coupling channel disposed at the other of the driven body or the drive body, wherein the coupling channel and the coupling protrusion are each disposed at a coupling axis offset from a common axis of the bit holder at a no load condition, and wherein the coupling protrusion extends into the coupling channel to operably couple the drive body to the driven body at the coupling axis.

15. The elastic torque transfer assembly of claim 14, wherein the drive body and the driven body meet at a coupling interface, and wherein the elastic torque transfer assembly further comprises a retaining ring disposed to extend around the coupling interface to resist misalignment of the drive body and the driven body responsive to application of torque to the impact bit holder.

16. The elastic torque transfer assembly of claim 15, further comprising a sleeve disposed to extend around the retaining ring and at least a portion of each of the drive body and the driven body.

17. The elastic torque transfer assembly of claim 16, wherein the sleeve is configured to axially retain the socket body relative to the base portion.

18. An elastic torque transfer assembly for a bit holder, the elastic torque transfer assembly comprising:

a first coupling protrusion disposed at one of a drive body or a coupling body of the bit holder;

a first coupling channel disposed at the other of the coupling body or the drive body, the first coupling protrusion and the first coupling channel each being offset from a common axis of the bit holder under no load at a first coupling axis;

a second coupling protrusion disposed at one of the driven body or the coupling body; and a second coupling channel is disposed at the other of the coupling body or the driven body, the second coupling protrusion and the second coupling channel each being offset from the common axis of the bit holder and the first coupling axis at a second coupling axis.

19. The elastic torque transfer assembly of claim 18, wherein the drive body and the coupling body meet at a first coupling interface, wherein the coupling body and the driven body meet at a second coupling interface, and wherein the elastic torque transfer assembly further comprises a retaining ring disposed to extend around the first and second coupling interfaces to resist misalignment of the drive body, the coupling body and the driven body responsive to application of torque to the impact bit holder.

20. The elastic torque transfer assembly of claim 19, further comprising a sleeve disposed to extend around the retaining ring and at least a portion of each of the drive body and the driven body.

* * * * *